United States Patent [19]

Sweet, Jr. et al.

[11] 4,086,115

[45] Apr. 25, 1978

[54] METHOD OF MAKING A HOCKEY STICK

[76] Inventors: Robert D. Sweet, Jr., 933 S. Juliana, Bedford, Pa. 15522; Peter J. Monaghan, 1900 Hiller Rd., West Bloomfield, Mich. 48033

[21] Appl. No.: 622,877

[22] Filed: Oct. 16, 1975

[51] Int. Cl.[2] ..... A63B 59/00

[52] U.S. Cl. ..... 156/178; 156/182; 156/293; 156/324; 264/258; 273/67 A; 273/DIG. 7

[58] Field of Search ..... 273/67 R, 67 A, 77 R, 273/80.1–80.8, 162 R, 167 R, DIG. 7, DIG. 23; 264/258; 156/176, 178, 180, 293, 302.1, 182, 324, 736, 441

[56] References Cited

U.S. PATENT DOCUMENTS

| | | | |
|---|---|---|---|
| 2,569,395 | 9/1951 | Zupaniek | 273/67 A |
| 2,628,099 | 2/1953 | Murphy | 273/162 R X |
| 2,705,336 | 4/1955 | Wilson | 273/162 R X |
| 3,185,603 | 5/1965 | Boggs | 156/436 |
| 3,336,426 | 8/1967 | Boggs | 273/DIG. 7 |
| 3,489,412 | 1/1970 | Franck et al. | 273/67 A |
| 3,561,760 | 2/1971 | Klay | 273/67 A |
| 3,638,942 | 2/1972 | Bassett | 273/67 A |
| 3,684,622 | 8/1972 | Goldsworth | 156/180 |
| 3,866,792 | 2/1975 | Minke | 273/DIG. 23 |
| 3,934,875 | 1/1976 | Easton et al. | 273/67 A |

FOREIGN PATENT DOCUMENTS

| | | | |
|---|---|---|---|
| 489,072 | 12/1952 | Canada | 273/67 A |
| 1,261,541 | 1/1972 | United Kingdom | 273/DIG. 23 |
| 1,349,906 | 4/1974 | United Kingdom | 273/DIG. 23 |
| 1,351,732 | 5/1974 | United Kingdom | 273/DIG. 23 |

OTHER PUBLICATIONS

"The Sporting Goods Dealer" Dec. 1972, pp. 49 & 116, "The Ram Rod".

"Polylite Polyester Resins", Reichhold Chemicals Inc., RCI Bld.-White Plaines, N.Y. 7/30/58.

*Primary Examiner*—David Klein
*Assistant Examiner*—Michael W. Ball
*Attorney, Agent, or Firm*—Harness, Dickey & Pierce

[57] ABSTRACT

A hockey stick is manufactured from a molded blade, a pultruded glass fiber shaft and a molded end cap. The interchangeable blade is made from a polycarbonate or wood. The shaft is hollow and made from glass fiber strips and rovings which are pulled through a heated die after being impregnated with a suitable resin to produce a shaft of rectangular section and of even wall thickness. The blade has a special tongue connection means on the supported end which snuggley fits into the end of the shaft and is adherred thereto by an adhesive such as an epoxy resin. The cap is cup-shaped and is preferably molded from a hard plastic and is adherred to the opposite end of the shaft from that supporting the blade to cover the end threreof. The cap could also be made from an elastomeric material to be frictionally retained in position over the shaft end. The use of the adhesive material makes certain that the cap will remain in place.

Should the blade be damaged, chipped, broken or otherwise unuseable, it is sawed or otherwise separated from the end of the shaft and another blade has its tongue inserted into and adherred to the opposite end of the shaft after the cap was removed or had the top portion sawed or otherwise removed therefrom. Unique options are provided for the user of the hockey stick. The flexiblity of the shaft as well as the blade may be changed and the curvature of the blades may be changed which provides a further selection.

1 Claim, 5 Drawing Figures

METHOD OF MAKING A HOCKEY STICK

BACKGROUND OF THE INVENTION

From a search of the art the following patents were uncovered which show hollow handles for the blade or head of clubs: U.S. Pat. No. 1,653,428 Brinkman; U.S. Pat. No. 2,353,991 Reach; U.S. Pat. No. 2,991,080 Redmond; U.S. Pat. No. 2,992,828 Stewart; U.S. Pat. No. 3,353,826 Traverse; U.S. Pat. No. 3,489,412 Franck et al.; U.S. Pat. No. 3,638,942 Bassett.

SUMMARY OF THE INVENTION

The invention pertains to a hockey stick having a special hollow shaft of rectangular section. The shaft is preferably formed from four strips of fiberglass two inches wide and a weight of 1½ ounces per square foot. Six 61 end yield rovings are distributed in the four walls of the fiberglass strips which is pressure impregnated with a predetermined selected resin mixture.

The shaft is manufactured by what is termed a pulltrusion technique or pulltruding. The strips of fiberglass are pulled through a heated die as they are pressure impregnated with a resin (preferably a thermosetting resin material) and after a predetermined length of the shaft has been formed by the die it is cut off while the pulltrusion is continued so that the shafts can be continuously made and cut off one after the other. The use of the fiberglass, the rovings and the resin produces a unique shaft having a predetermined flexibility.

If the shaft is to be more rigid, further reinforcement is necessary to reduce the flexibility thereof. The resin and fiberglass material above set forth will be used with a greater number of rovings of Kevlar 49 substituted for the above mentioned rovings which may be increased to 16 or more. Kevlar is a trademark of E. I. De Nemours Du Pont & Co. which embodies an aramid fiber which is employed as rovings in the sides and walls of the fiberglass strips. As the fiberglass strips with the aramid fibers therein are pulled through the heated die with the same resin used to pressure impregnate the fibers and rovings, the shafts resulting therefrom are much stiffer than those employing the first said rovings.

Alternatively in place of the Kevlar fibers, carbon-graphite type fibers may be used for reinforcements. The carbon-graphite type fibers when so used also produce excellent results.

The blade is molded from a suitable resin such as polycarbonate alone or reinforced with 40% by weight of fiberglass or other reinforcing material. Excellent interchangeable blades may also be formed from wood. The attached end of the blade has a special tongue which snuggley fits within one end of the shaft in which it is retained by suitable means such as an adhesive for example of the epoxy type. A shoulder at the base of the tongue, the thickness of the wall of the shaft, is provided thereon to form a smooth joint when the blade tongue is secured within the shaft end.

As was pointed out above, the polycarbonate or similar material produces an extremely tough blade which may be reinforced by glassfibers or similar material and which may have a slight concave curve on the striking face of different curvature. This gives the person using the hockey stick a choice which includes the selection of a shaft of predetermined rigidity or flexibility and a selection of a blade of various curved forms and of varying toughness and flexibility when using glassfibers or other strengthening materials. The opposite open end of the shaft may be closed by a cap of inverted cup shape which fits snuggley within or over the outersurface of the shaft end to which it is secured, preferably by a bonding agent such as an epoxy. The cap can be made of any suitable material, such as a hard plastic material or fiberglass treated with a polyester or the like, or it may be made from elastomeric material which provides a frictional securing force along with that of an adhesive by which it is secured to the end of the shaft.

Should the blade be damaged, it may be removed, preferably by having the tongue sawed from the blade at the end of the shaft and the tongue of a new blade inserted into and adherred to the opposite end of the shaft which was enclosed by the cap after the upper portion of the cap is removed, for example, by sawing. In this manner, a hockey stick may be constructed which has a durable shaft, stronger than the wood shaft now employed, and a tough blade. Moreover, the unique construction of this hockey stick permits that interchangeable wood blades of various curvatures may be insertably connected with the hollow shaft for trial so as to allow a purchaser to select an optimum blade and shaft combination.

Thus, in accordance with the invention a selection is provided to one using the hockey stick of having a special shaft of desired flexibility and a special interchangeable blade which is tough and provided with a flexibility and curvature which propels a puck at a maximum speed and distance.

DESCRIPTION OF THE PREFERRED EMBODIMENT

Figure 1:
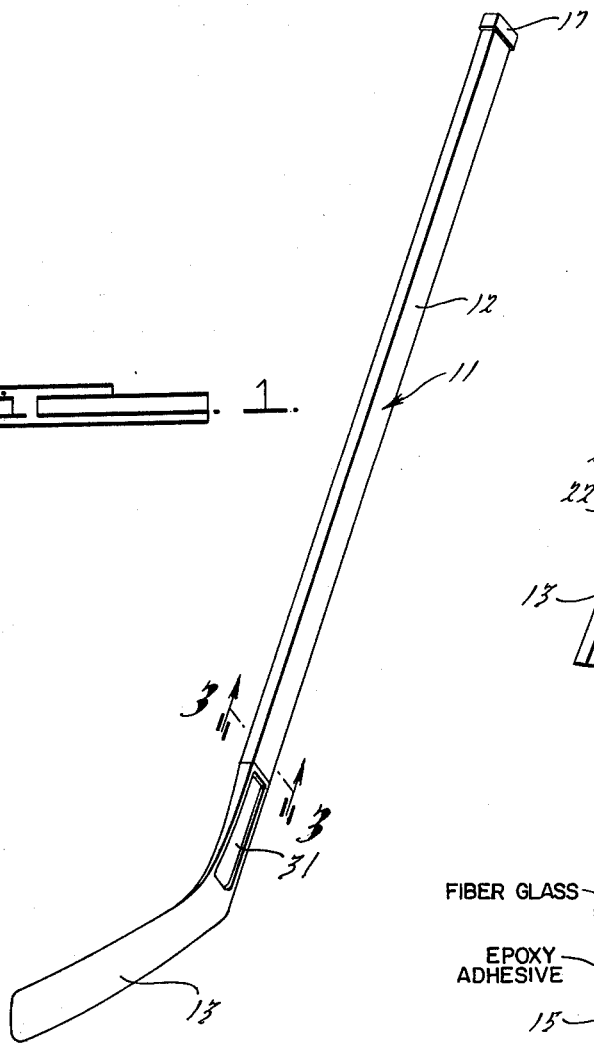
FIG. 1 is a perspective view of a hockey stick having a hollow shaft and a solid molded blade embodying features of the present invention.
Figure 2:
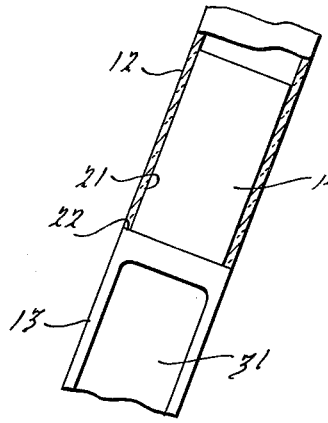
FIG. 2 is an enlarged broken, sectional view of the structure illustrated in FIG. 1, located within the circle 2 thereof.
Figure 3:
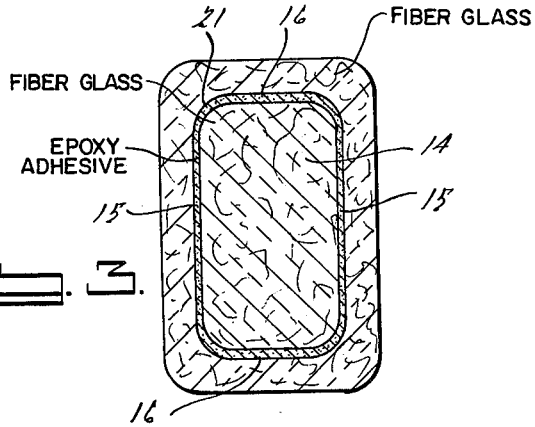
FIG. 3 is an enlarged sectional view of the structure illustrated in FIG. 1, taken on the line 3—3 thereof.
Figure 4:
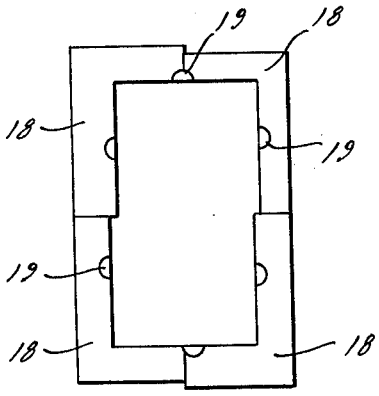
FIG. 4 is a view of fiberglass strips with rovings therein from which the shaft of the hockey stick is constructed.
Figure 5:
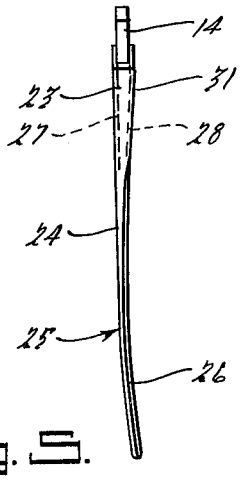
FIG. 5 is a view of the blade which is employed in the hockey stick of FIG. 1.

The hockey stick 11, illustrated in FIG. 1, is constructed from a hollow fiberglass shaft 12 and a wood or molded plastic blade 13 which is provided with a tongue 14 on the supported end which fits snuggley into the end of the shaft 12. The sides 15 of the tongue 14 has a clearance of about 0.020 inches, as illustrated in FIG. 3. The clearance area is filled with a suitable epoxy which rigidly secures the blade to the end of the shaft. A cap 17, of inverted cup shape, snuggley fits over the outer surface of the shaft 12 and is adherred thereto so as to be rigid therewith.

The shaft 12 is constructed from four fiberglass strips 18 of 1½ ounces per square foot density by weight and approximately 2 inches in width which along with bundles of rovings 19 are pulled through a heated die as it is pressure impregnated with a polyester resin mixture as set forth below. Two bundles of fiberglass rovings are provided on each of the sides and one on each of the ends. The rovings are provided in strands of 61 yards per pound and when used produces a unique type of shaft having a predetermined degree of flexibility. The shaft is hollow and rectangular in shape having a wall thickness of approximately one-eighth inches with the sides approximately one and one-eighth inches long and the width approximately three-fourths inches. This leaves an interior hollow dimension of approximately seven-eights inches by one-half inch. The strips of fiberglass 18 reinforced by the rovings 19 are pressure impregnated with the resin material embodying the following formulation.

| | |
|---|---|
| Polyester resin | 252 lbs. |
| Styrene monomer | 12 lbs. |
| White Pigment | 6 lbs. |
| Zelec UN(release agent) | 3 lbs. |
| ASP400 | 60 lbs. |
| BFF-70 | 4¼ lbs. |

A suitable polyester resin would be that secured from Koppers Corporation 6101. Styrene monomer is readily available in the trade. The white pigment would be a polyester compatible pigment. The Zelec UN is obtainable from DuPont. ASP400 is a filler clay readily obtainable. BFF-70 is a catalyst known as Benzyl peroxide. The pulling proceeds with a uniform movement and after the shaft 12 of predetermined length has been formed, it is cut off while the material is continuously pulled through the die.

If it is desired to reduce the flexibility and provide a stiffer shaft, the rovings 18 are replaced by 16 rovings obtained from Kevlar 49 which are forced into the fiberglass strips when pulled through the heated die resulting in a greater rigidity to the hollow shaft when the same resin is employed. A combination of both rovings 18 and Kevlar can be used to obtain stiffness between the two extremes. Alternatively a carbon-graphite fiber material may be used in place of the Kevlar or in combination therewith to obtain different flexing properties for the shaft. The Kevlar material is an aramid fiber which is produced by E. I. De Nemours Du Pont and Co., 1001 Market Street, Wilmington, Delaware. With this arrangement, a shaft 12 can be produced which is stable, which is uniform throughout its length, which has various degrees of flexibility and rigidity and which is substantially safer than the wood shafts now employed, since when broken, the wood shaft may pierce and do bodily damage to a player.

The blade 13, as pointed out hereinabove, is made from either wood or a polycarbonate material which is extremely tough and durable and which may be reinforced with a substantial amount of fiberglass, up to 40% of fiberglass by weight. The blade is provided with varying curvatures so a blade 13 may be selected for a desired shape with the supported end having a tongue 14, as pointed out hereinabove which snuggley fits within the hollow interior at the end of the shaft 12.

A resin 21, such as epoxy, is employed in the areas 15 and 16 between the tongue and the inner surface of the shaft which had been roughened so that the resin used as the adhesive will provide a satisfactory bond therewith. The blade 13 has a shoulder 22 the thickness of the shaft wall, so as to be a continuation of the outer sides thereof. The blade section 23 at the base of the tongue is approximately one-half inches in thickness while at the end of the shank portion at 24 from which the blade extends outwardly, has a thickness of approximately one-fourth inches. The blade portion 25 will be approximately one-eighth inches in thickness and will be curved at 26 with the concaved side forming the striking face. The curvature will be varied from a substantially straight face to one having a recognized amount of curvature therein.

The resulting hockey stick is extremely durable and withstands the pounding on the hard ice to a greater degree than a wood shaft hockey stick could withstand. The wood shaft hockey sticks often become broken and the blades become split and cracked and a substantial amount of care and upkeep is required to retain the sticks serviceable. The present hockey stick will outlast the conventional wood shaft stick by a considerable factor. The stronger shaft will not shatter and break as occurs to a wood shaft hockey stick thereby decreasing the risk of injury to the players. The hockey stick of the present invention is substantially lighter and more durable than the present wood shaft hockey stick, permitting the user to select a shaft and blade by which the player can apply a maximum force and speed to the puck when it is struck.

Another unique feature is that the color, both in the shaft and also in the plastic blade, is produced by impregnation and will not deteriorate with age.

A further feature of the invention relies in the second use of the shaft 12 in case the blade 13 becomes damaged. It is removed from the shaft, preferably by sawing the blade from the tongue at the end of the shaft and adherring a cap thereover while the same or different type of blade has its tongue inserted into and adherred by an epoxy to the roughened internal surface at the end of the shaft having the cap after the top closure part thereof has been removed, preferably by sawing. The hockey stick thus renewed is as good as when originally provided with an extended life as the characteristics of the shaft and blade do not change from use.

Still another important feature is that the hockey stick when sold in stores, can have a large container full of different curvature blades on display, any one or more of which can be selected by the purchaser and then used with the shaft which is also sold separately.

The portion of the blade between the points 23 and 24 at the base of the tongue 14 has recesses 27 and 28 on opposite sides which are of uniform depth. Both of the sides forming the bottom of the recesses 27 and 28 are in sloping relation to each other and lightens the blade while providing reinforcing flanges 31 within the shank which substantially strengthens the portion of the blade below the tongue so that it will withstand the forces applied to the blade when the puck is struck.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed:

1. A method of constructing a hockey stick comprising:

assembling four continuous fiberglass strips in such a manner as to form a rectangular cross sectionally shaped continuous hollow member defined by longitudinally extending opposing end walls and sidewalls;

placing two spaced bundles of rovings along each sidewall of said rectangular shape and one bundle of rovings along each end wall of said rectangular shape;

continuously pulling said fiberglass strips and said bundles of rovings through a heated die;

pressure impregnating said fiberglass strips and said rovings with a resin while said rovings and said fiberglass strips are being pulled through said heated die so as to form a hollow elongated member of even wall thickness;

severing shafts of predetermined length from said elongated member while continuing to pull said strips and bundles through said die;

forming a hockey stick blade with an integral rectangular shaped elongated tongue portion of a cross sectional size smaller than the interior cross section of said shaft;

providing an annular shoulder on said blade surrounding said tongue having a width equal to the width of the wall thickness of said shaft so as to blend smoothly therewith;

providing recesses on opposite sides of said blade adjacent said tongue portion, said recesses being defined in part by reinforcing flange portions which act to reinforce said blade and by a portion of said annular shoulder;

applying a layer of epoxy to said shaft interior and to said tongue portion; and inserting said tongue portion into one end of said hockey stick.

* * * * *